US008242984B2

(12) United States Patent
Choi

(10) Patent No.: US 8,242,984 B2
(45) Date of Patent: Aug. 14, 2012

(54) ORGANIC LIGHT EMITTING DISPLAY

(75) Inventor: Sang-Moo Choi, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 381 days.

(21) Appl. No.: 12/713,154

(22) Filed: Feb. 25, 2010

(65) Prior Publication Data

US 2010/0220093 A1 Sep. 2, 2010

(30) Foreign Application Priority Data

Mar. 2, 2009 (KR) ..... 10-2009-0017542

(51) Int. Cl.
*G09G 3/30* (2006.01)

(52) U.S. Cl. ..... 345/76; 345/82

(58) Field of Classification Search ..... 345/76–83, 345/204–215, 690–699; 315/169.1–169.4
See application file for complete search history.

(56) References Cited

U.S. PATENT DOCUMENTS

| | | | | |
|---|---|---|---|---|
| 7,218,295 | B2 * | 5/2007 | Sung | 345/82 |
| 7,317,435 | B2 * | 1/2008 | Hsueh | 345/82 |
| 2007/0279337 | A1 * | 12/2007 | Kim et al. | 345/76 |
| 2008/0036710 | A1 * | 2/2008 | Kim | 345/82 |
| 2009/0225012 | A1 * | 9/2009 | Choi | 345/80 |
| 2009/0243977 | A1 * | 10/2009 | Chung | 345/76 |
| 2009/0243979 | A1 * | 10/2009 | Kim | 345/76 |
| 2010/0328276 | A1 * | 12/2010 | Huh | 345/204 |

FOREIGN PATENT DOCUMENTS

| | | | |
|---|---|---|---|
| KR | 10-0719924 | B1 | 5/2007 |
| KR | 10-2007-0112714 | A | 11/2007 |
| KR | 10-2007-0118857 | A | 12/2007 |
| KR | 10-0833760 | B1 | 5/2008 |
| KR | 10-2008-0112630 | | 12/2008 |
| KR | 1020090004635 | A | 1/2009 |

OTHER PUBLICATIONS

Korean Office action dated Nov. 10, 2010 for the corresponding Korean Priority Application No. 10-2009-001742, 4 pages.

KIPO Office Action dated Jul. 18, 2011 for Korean priority patent application 10-2009-0017542, noting the listed references in this IDS, as well as KR 10-2009-0004635 previously submitted in an IDS dated Nov. 23, 2010, 1 page.

Korean Patent Abstracts for Korean Publication 10-2006-0113194, dated Nov. 2, 2006, corresponding to Korean Patent 10-0719924 listed above.

Korean Patent Abstracts for Korean Publication 10-2008-0112630, corresponding to Korean Patent 10-0882907 B1 dated Feb. 10, 2009.

* cited by examiner

*Primary Examiner* — Nitin Patel
(74) *Attorney, Agent, or Firm* — Christie, Parker & Hale, LLP

(57) ABSTRACT

An organic light emitting display includes pixels positioned at crossing regions of scan lines, emission control lines, and data lines. Each of the pixels positioned on an ith horizontal line includes an organic light emitting diode (OLED), a first transistor coupled between a corresponding one of power source lines and an anode electrode of the OLED for controlling current supplied to the OLED, a second transistor turned on when a scan signal is supplied to an ith scan line for supplying the data signal from a corresponding one of the data lines to a gate electrode of the first transistor, a third transistor coupled between the first transistor and the corresponding one of the power source lines and having a gate electrode coupled to an ith emission control line, and a storage capacitor coupled between the gate electrode of the first transistor and the anode electrode of the OLED.

22 Claims, 6 Drawing Sheets

ORGANIC LIGHT EMITTING DISPLAY

CROSS-REFERENCE TO RELATED APPLICATION

This application claims priority to and the benefit of Korean Patent Application No. 10-2009-0017542, filed on Mar. 2, 2009, in the Korean Intellectual Property Office, the entire content of which is incorporated herein by reference.

BACKGROUND

1. Field of the Invention

The present invention relates to an organic light emitting display.

2. Description of the Related Art

Recently, various flat panel displays (FPDs) having reduced weight and volume when compared to cathode ray tubes (CRTs) have been developed. The FPDs include liquid crystal displays (LCDs), field emission displays (FEDs), plasma display panels (PDPs), and organic light emitting displays, among others.

Among the FPDs, the organic light emitting displays display images using organic light emitting diodes (OLEDs) that generate light by the re-combination of electrons and holes. The organic light emitting display has high response times and is driven with low power consumption.

FIG. 1 is a circuit diagram illustrating a pixel of a conventional organic light emitting display. In FIG. 1, the transistors included in the pixel are NMOS transistors.

Referring to FIG. 1, a pixel 4 of the conventional organic light emitting display includes an organic light emitting diode (OLED) and a pixel circuit 2 coupled to a data line Dm and a scan line Sn to control the OLED.

The anode electrode of the OLED is coupled to the pixel circuit 2 and the cathode electrode of the OLED is coupled to a second power source ELVSS. The OLED generates light with predetermined brightness corresponding to current supplied from the pixel circuit 2.

The pixel circuit 2 controls the amount of current supplied to the OLED corresponding to a data signal supplied to the data line Dm when a scan signal is supplied to the scan line Sn. Therefore, the pixel circuit 2 includes a second transistor M2 (that is, a driving transistor) coupled between a first power source ELVDD and the OLED, a first transistor M1 coupled between the second transistor M2 and the data line Dm, with a gate electrode coupled to the scan line Sn, and a storage capacitor Cst coupled between a gate electrode and the second electrode of the second transistor M2.

The gate electrode of the first transistor M1 is coupled to the scan line Sn and the first electrode is coupled to the data line Dm. The second electrode of the first transistor M1 is coupled to one terminal of the storage capacitor Cst. Here, the first electrode of the first transistor M1 is set as one of a source electrode or a drain electrode, and the second electrode is the other one of the source electrode or the drain electrode. For example, when the first electrode is the source electrode, the second electrode is the drain electrode. The first transistor M1 is turned on when a scan signal is supplied from the scan line Sn, and supplies a data signal supplied from the data line Dm to the storage capacitor Cst. At this time, the storage capacitor Cst charges a voltage corresponding to the data signal.

The gate electrode of the second transistor M2 is coupled to one terminal of the storage capacitor Cst and the first electrode is coupled to the first power source ELVDD. The second electrode of the second transistor M2 is coupled to the other terminal of the storage capacitor Cst and the anode electrode of the OLED. The second transistor M2 controls the amount of current supplied from the first power source ELVDD to the second power source ELVSS via the OLED corresponding to the voltage stored in the storage capacitor Cst.

One terminal of the storage capacitor Cst is coupled to the gate electrode of the second transistor M2 and the other terminal of the storage capacitor Cst is coupled to the anode electrode of the OLED. The storage capacitor Cst charges the voltage corresponding to the data signal.

The conventional pixel 4 supplies a current corresponding to the voltage charged in the storage capacitor Cst to the OLED to display an image with predetermined brightness. However, the above-described conventional organic light emitting display cannot display an image with uniform brightness due to variations in the threshold voltages of the second transistors M2 of the pixels.

That is, when the threshold voltage of the second transistor M2 varies for each of the pixels 4, the pixels 4 generate light with different brightness for a same data signal, and therefore an image with uniform brightness cannot be displayed.

SUMMARY OF THE INVENTION

Accordingly, exemplary embodiments of the present invention provide an organic light emitting display for compensating for the threshold voltages of driving transistors.

According to an exemplary embodiment of the present invention, there is provided an organic light emitting display including a scan driver for sequentially supplying a scan signal to scan lines and sequentially supplying an emission control signal to emission control lines, a data driver for supplying a data signal to data lines in synchronization with the scan signal supplied to the scan lines, a power source unit for supplying a first power to power source lines, and pixels positioned at crossing regions of the scan lines, the emission control lines, and the data lines. Each of the pixels positioned on an ith (i is a natural number) horizontal line includes an organic light emitting diode (OLED), a first transistor coupled between a corresponding one of the power source lines and an anode electrode of the OLED for controlling current supplied to the OLED, a second transistor turned on when the scan signal is supplied to an ith scan line of the scan lines for supplying the data signal from a corresponding one of the data lines to a gate electrode of the first transistor, a third transistor coupled between the first transistor and the corresponding one of the power source lines and having a gate electrode coupled to an ith emission control line of the emission control lines, and a storage capacitor coupled between the gate electrode of the first transistor and the anode electrode of the OLED.

The scan driver may be configured to supply the emission control signal to the ith emission control line concurrently with supply of the scan signal to an (i−1)th scan line of the scan lines or the ith scan line. The emission control signal may be set at a voltage for setting the third transistor to a weak turn-on state. The organic light emitting display may further include a fourth transistor coupled between the third transistor and the OLED, and turned on when a scan signal is supplied to the ith scan line. The organic light emitting display may alternatively further include a fourth transistor coupled between the anode electrode of the OLED and an initialization power source, and turned on when the scan signal is supplied to the (i−1)th scan line.

The scan driver may be further configured to sequentially supply a boosting signal to boosting lines. The boosting signal supplied to an ith boosting line of the boosting lines may be supplied concurrently with the emission control signal supplied to the ith emission control line, and may be set at a voltage having a polarity opposite to a polarity of a voltage of the emission control signal. The organic light emitting display may further include a boosting capacitor coupled between the ith boosting line and the gate electrode of the first transistor. A voltage of the data signal may be higher than a voltage of a gray level to be displayed. The organic light emitting display may alternatively further include a boosting capacitor coupled between the ith scan line and the gate electrode of the first transistor.

According to the organic light emitting display of exemplary embodiments of the present invention, an image with uniform brightness can be displayed independent of the threshold voltage variations of the driving transistors.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
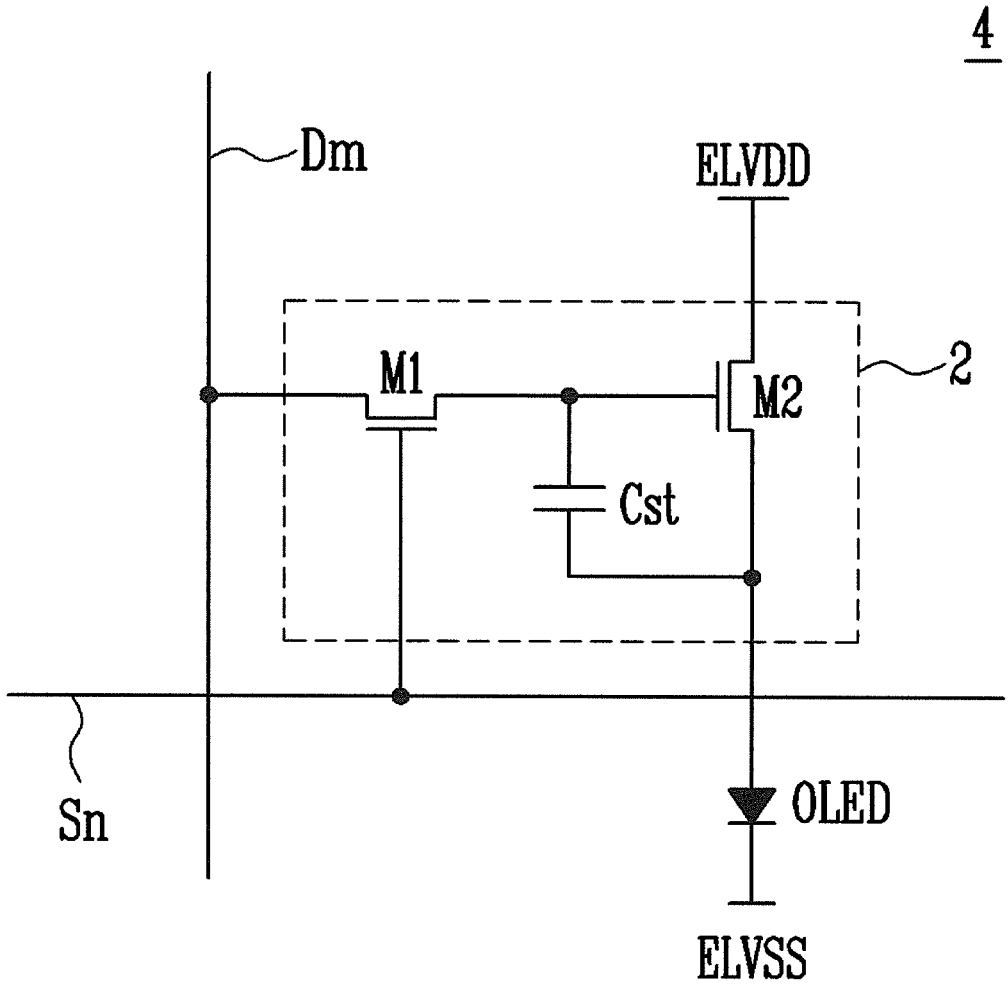
FIG. 1 is a circuit diagram illustrating a pixel of a conventional organic light emitting display.

Hereinafter, certain exemplary embodiments according to the present invention will be described with reference to the accompanying drawings. Here, when a first element is described as being coupled to a second element, the first element may be directly coupled to the second element or may be indirectly coupled to the second element via one or more additional elements. Further, some of the elements that are not essential to the complete understanding of the invention are omitted for clarity. Also, like reference numerals refer to like elements throughout.

Hereinafter, the exemplary embodiments will be described in detail with reference to the accompanying drawings, i.e., FIGS. 2 to 10.

Figure 2:
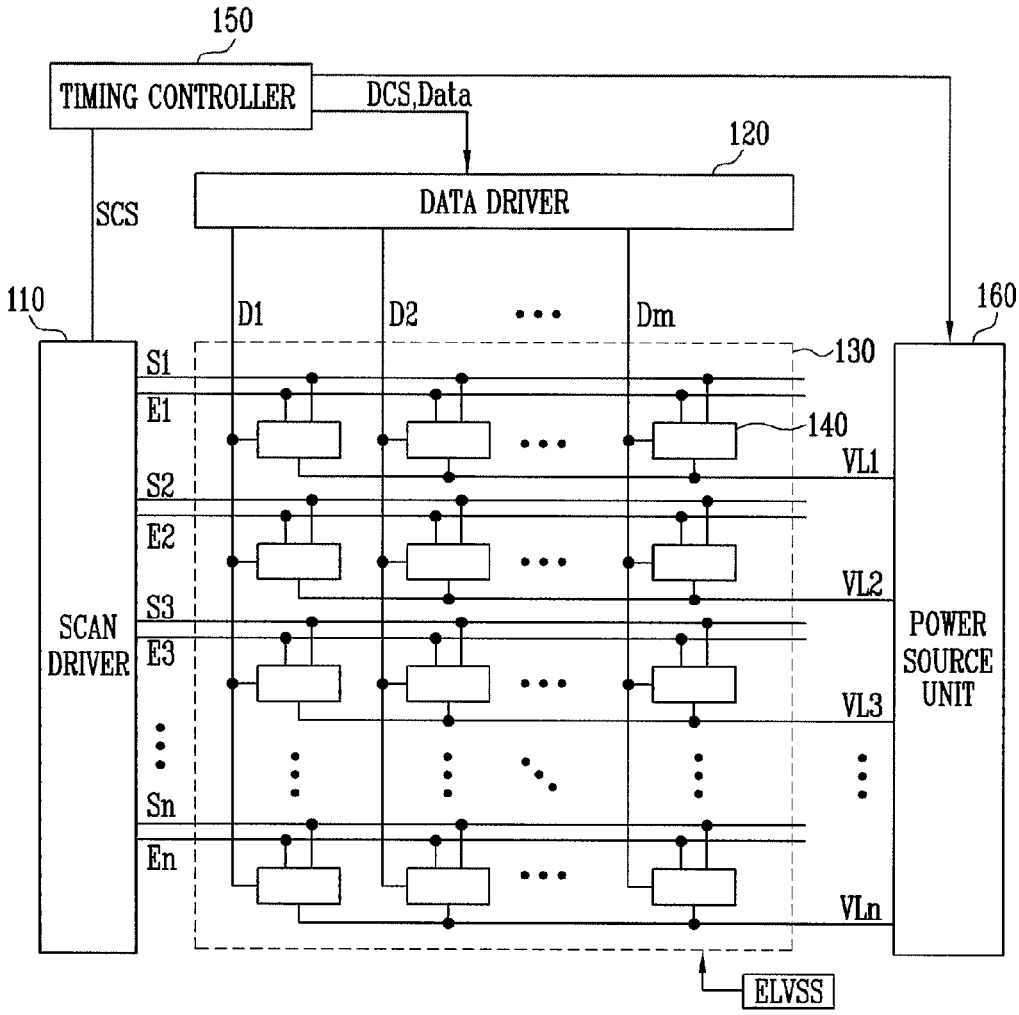
FIG. 2 schematically illustrates an organic light emitting display according to an embodiment of the present invention.

FIG. 2 schematically illustrates an organic light emitting display according to an embodiment of the present invention.

Referring to FIG. 2, an organic light emitting display according to an embodiment of the present invention includes pixels 140 respectively coupled to scan lines S1 to Sn, emission control lines E1 to En, and data lines D1 to Dm, a scan driver 110 for driving the scan lines S1 to Sn and the emission control lines E1 to En, a data driver 120 for driving the data lines D1 to Dm, a power source unit 160 for driving power source lines VL1 to VLn, and a timing controller 150 for controlling the scan driver 110, the data driver 120, and the power source unit 160.

The scan driver 110 receives a scan driving control signal SCS from the timing controller 150. The scan driver 110 generates scan signals and sequentially supplies the generated scan signals to the scan lines S1 to Sn. In addition, the scan driver 110 generates emission control signals and sequentially supplies the generated emission control signals to the emission control lines E1 to En. Here, the emission control signal supplied to the ith (i is a natural number) emission control line Ei substantially overlaps with the scan signals supplied to the (i−1)th scan line Si−1 and the ith scan line Si.

The power source unit 160 supplies a first power (e.g., a first power source) having a first voltage or a second voltage to the power source lines VL1 to VLn. Actually, the power source unit 160 supplies the first voltage to the ith power source line VLi concurrently with the scan signal supplied to the (i−1)th scan line Si−1, and supplies the second voltage to the other power source lines VL1 to VLi−1 and VLi+1 to Vn. Here, the power source lines VL1 to VLn run parallel with the scan lines S1 to Sn so that the first power source can be supplied to the pixels 140 in units of horizontal lines.

According to an embodiment of the present invention, the voltage of the first power source can vary with the structure of the pixels 140. For example, the first power source having the second voltage can be supplied to the power source lines VL1 to VLn, without varying the voltage.

The data driver 120 receives a data driving control signal DCS from the timing controller 150. The data driver 120 supplies data signals to the data lines D1 to Dm in synchronization with the scan signals.

The timing controller 150 generates the data driving control signal DCS and the scan driving control signal SCS corresponding to synchronizing signals supplied from the outside. The data driving control signal DCS generated by the timing controller 150 is supplied to the data driver 120, and the scan driving control signal SCS is supplied to the scan driver 110. The timing controller 150 controls the power source unit 160 corresponding to the synchronizing signals. In addition, the timing controller 150 supplies data Data supplied from the outside to the data driver 120.

A display region 130 includes the plurality of pixels 140 arranged in a matrix. Each of the pixels 140 supplies current corresponding to data signals from the first power source to the second power source ELVSS via corresponding OLEDs to generate light (e.g., predetermined light). The pixels 140 include a plurality of transistors (which, in this embodiment, are NMOS transistors) and supplies current via a driving transistor to the OLED, the current adjusted or compensated corresponding to the threshold voltage of the driving transistor.

Figure 3:
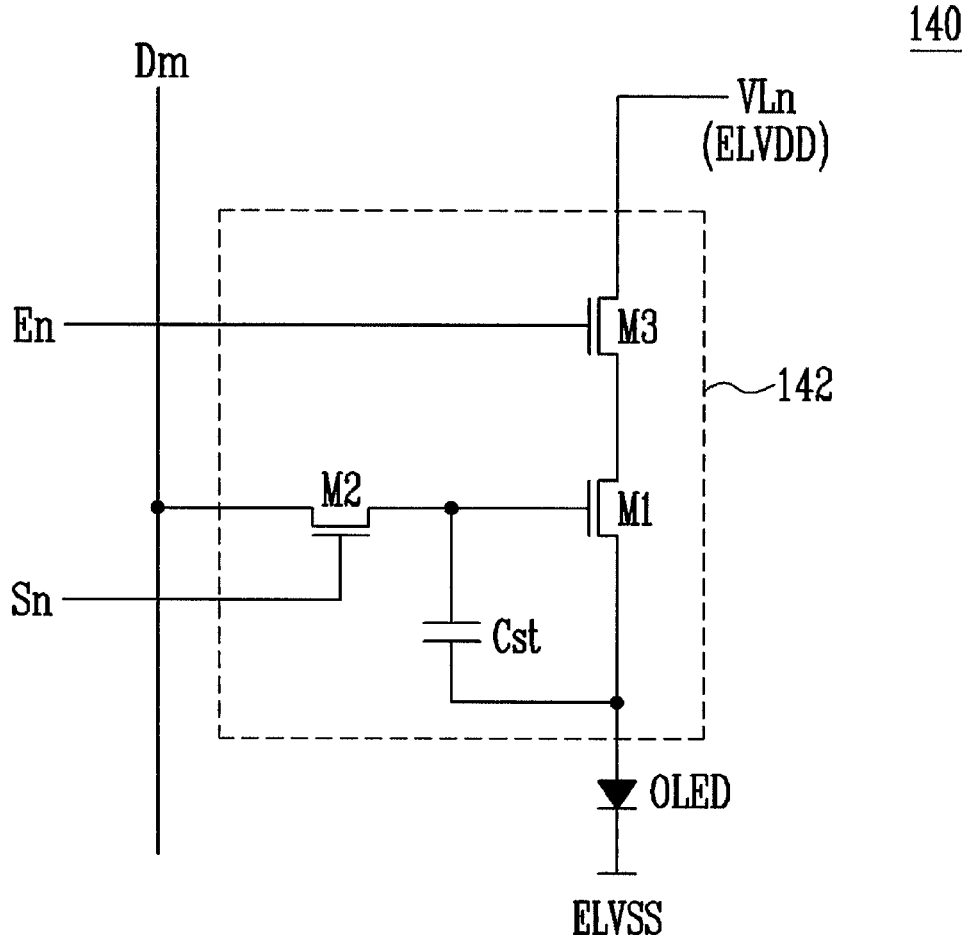
FIG. 3 illustrates a circuit diagram of an embodiment of the pixel of FIG. 2.

FIG. 3 illustrates a circuit diagram of a pixel according to an embodiment of the present invention. In FIG. 3, for convenience sake, a pixel coupled to an nth scan line Sn and an mth data line Dm is illustrated.

Referring to FIG. 3, the pixel 140 includes an OLED and a pixel circuit 142 coupled to the data line Dm, the emission control line En, and the scan line Sn to control the OLED.

The anode electrode of the OLED is coupled to the pixel circuit 142 and the cathode electrode of the OLED is coupled to a second power source ELVSS. The OLED generates light with brightness (e.g., predetermined brightness) corresponding to current supplied from the pixel circuit 142.

The pixel circuit 142 charges a voltage corresponding to a data signal and the threshold voltage of a first transistor M1

(that is, a driving transistor) in a storage capacitor Cst, and supplies the current corresponding to the charged voltage to the OLED. The pixel circuit 142 includes first to third transistors M1 to M3 and the storage capacitor Cst.

A gate electrode of a second transistor M2 is coupled to the scan line Sn and a first electrode of the second transistor M2 is coupled to the data line Dm. A second electrode of the second transistor M2 is coupled to a gate electrode of the first transistor M1. The second transistor M2 is turned on when a scan signal (e.g., high voltage) is supplied to the scan line Sn for supplying a data signal from the data line Dm to the gate electrode of the first transistor M1.

The gate electrode of the first transistor M1 is coupled to the second electrode of the second transistor M2 and a first electrode of the first transistor M1 is coupled to a second electrode of a third transistor M3. A second electrode of the first transistor M1 is coupled to the anode electrode of the OLED. The first transistor M1 controls the amount of current supplied from a power source line VLn to the OLED corresponding to the voltage applied to the gate electrode thereof.

A gate electrode of the third transistor M3 is coupled to the emission control line En and a first electrode of the third transistor M3 is coupled to the power source line VLn. The second electrode of the third transistor M3 is coupled to the first electrode of the first transistor M1. The third transistor M3 is driven corresponding to the emission control signal supplied to the emission control line En.

A first terminal of the storage capacitor Cst is coupled to the gate electrode of the first transistor M1 and a second terminal of the storage capacitor Cst is coupled to the anode electrode of the OLED. The storage capacitor Cst charges the voltage corresponding to the data signal and the threshold voltage of the first transistor M1.

Figure 4:
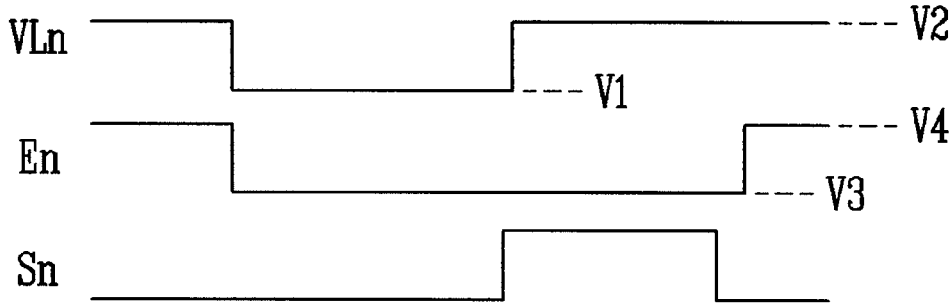
FIG. 4 illustrates waveforms describing a method of driving the pixel of FIG. 3.

FIG. 4 illustrates waveforms for driving the pixel of FIG. 3.

When describing processes of operating the pixel 140 in detail with reference to FIGS. 3 and 4, a first power source ELVDD is first set at a first voltage V1 and is supplied to the power source line VLn. An emission control signal is concurrently supplied to the emission control line En. Here, the emission control signal is set at a third voltage V3, and the value of the third voltage V3 is set so that the third transistor M3 is in a weak turn-on state.

In this case, the anode electrode of the OLED is initialized by the first power source ELVDD of the first voltage V1 supplied to the power source line VLn. Here, the value of the first voltage V1 is set so that the OLED is sufficiently turned off.

After the OLED is turned off, the first power source ELVDD having the second voltage V2 higher than the first voltage V1 is supplied to the power source line VLn and a scan signal (having a high voltage) is supplied to the scan line Sn. When the second voltage V2 is supplied to the power source line VLn, the voltage of the second electrode of the third transistor M3 and the voltage of the second electrode of the first transistor M1 gradually increase. Actually, the voltage of the second electrode of the third transistor M3 and the voltage of the second electrode of the first transistor M1 increase to the voltage V3−Vth(M3) obtained by subtracting the threshold voltage of the third transistor M3 from the third voltage V3. After the voltage of the second electrode of the third transistor M3 increases to the voltage obtained by subtracting the threshold voltage of the third transistor M3 from the third voltage V3, the third transistor M3 is turned off.

The second voltage V2 for supplying current to the OLED is a sufficiently high voltage. For example, the second voltage V2 is a higher voltage than a fourth voltage V4 applied later to the emission control line En.

When the scan signal is supplied to the scan line Sn, the second transistor M2 is turned on. When the second transistor M2 is turned on, the data signal from the data line Dm is supplied to the gate electrode of the first transistor M1.

In this case, Vgs of the first transistor M1 can be represented by EQUATION 1.

$$Vgs = V\text{data} - V3 + Vth(M3) \quad \text{[EQUATION 1]}$$

Here, Vdata denotes the voltage of the data signal. After the voltage corresponding to EQUATION 1 is charged in the storage capacitor Cst, the supply of the scan signal is suspended. When the supply of the scan signal is suspended, the second transistor M2 is turned off.

Then, the supply of the emission control signal to the emission control line En is suspended. When the supply of the emission control signal to the emission control line En is suspended, the voltage of the emission control line En increases to the fourth voltage V4, which is higher than the third voltage V3. Here, the fourth voltage V4 is set so that the third transistor M3 can be sufficiently turned on.

In this case, the first transistor M1 supplies the current corresponding to the voltage charged in the storage capacitor Cst to the OLED via the third transistor M3. Actually, the current supplied to the OLED can be represented by EQUATION 2.

$$\text{loled} = \beta(Vgs - Vth(M1))^2 = \beta(V\text{data} - V3 + Vth(M3) - Vth(M1))^2 \approx \beta(V\text{data} - V3)^2 \quad \text{[EQUATION 2]}$$

Here, β and loled denote a constant and the current that flows to the OLED, respectively, and it is assumed that the threshold voltage of the first transistor M1 is equal or substantially similar to the threshold voltage of the third transistor M3. Actually, the threshold voltages of the first transistor M1 and the third transistor M3 included in the same pixel are set to be almost the same.

Referring to EQUATION 2, the current that flows to the OLED is determined independent of the threshold voltage of the first transistor M1. Therefore, according to embodiments of the present invention, an image with uniform brightness can be displayed. In addition, according to embodiments of the present invention, the voltage charged in the storage capacitor Cst is determined independent of the voltage of the second power source ELVSS. That is, since the voltage charged in the storage capacitor Cst is determined regardless of a voltage drop of or variances associated with the second power source ELVSS, an image with desired brightness can be more effectively displayed.

Figure 5:
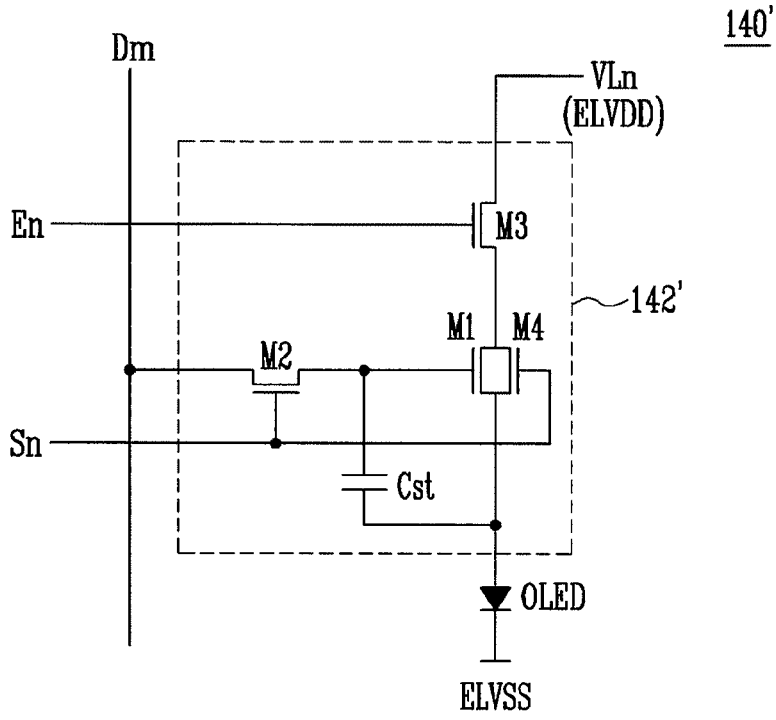
FIG. 5 illustrates a circuit diagram of another embodiment of the pixel of FIG. 2.

FIG. 5 illustrates a circuit diagram of a pixel according to another embodiment of the present invention. In FIG. 5, the same elements as the elements of FIG. 3 are denoted by the same reference numerals, and a detailed description thereof will be omitted.

Referring to FIG. 5, the pixel 140' further includes a fourth transistor M4 coupled between the second electrode of the third transistor M3 and the anode electrode of the OLED. The fourth transistor M4 is turned on when a scan signal is supplied to the scan line Sn.

To be specific, a time for which the voltage corresponding to the threshold voltage of the third transistor M3 is charged in the storage capacitor Cst is affected by the current that flows through the first transistor M1. For example, when the voltage of a data signal is low, the amount of current that flows through the first transistor M1 is reduced, such that a time for which the voltage corresponding to the threshold voltage of the third transistor M3 is charged in the storage capacitor Cst increases.

Therefore, according to the embodiment of FIG. 5, while the scan signal is supplied to the scan line Sn, the fourth transistor M4 is turned on so that the voltage corresponding to the threshold voltage of the third transistor M3 is charged in the storage capacitor Cst within a short time, regardless of the voltage of the data signal. Since the other operation processes are the same as the operation processes according to the embodiment of the present invention illustrated in FIG. 3, a more detailed description thereof will be omitted.

Figure 6:
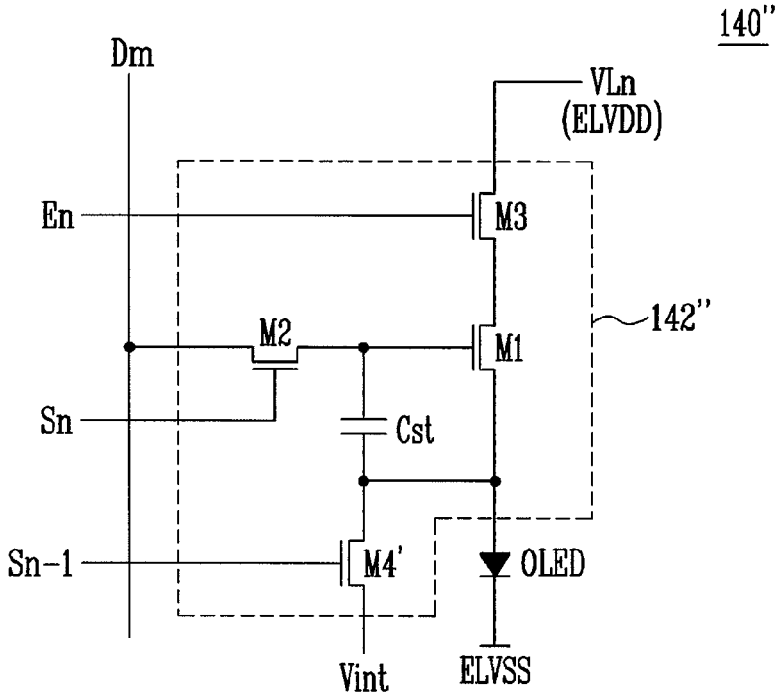
FIG. 6 illustrates a circuit diagram of another embodiment of the pixel of FIG. 2.

FIG. 6 illustrates a circuit diagram of a pixel according to another embodiment of the present invention. In FIG. 6, the same elements as the elements of FIG. 3 are denoted by the same reference numerals, and a detailed description thereof will be omitted.

Referring to FIG. 6, the pixel 140" further includes a fourth transistor M4' coupled between the anode electrode of an OLED and an initialization power source Vint. The fourth transistor M4' is turned on when a scan signal is supplied to the (n−1)th scan line Sn−1.

That is, according to the embodiment of FIG. 6, the fourth transistor M4' is turned on when the scan signal is supplied to the (n−1)th scan line Sn−1 to initialize the voltage of the anode electrode of the OLED to the voltage of the initialization power source Vint. Here, the initialization power source Vint has the same voltage as the voltage of the first power source V1 described according to the embodiment of the present invention illustrated in FIG. 3.

According to this embodiment of the present invention, since the OLED is initialized using the initialization power source Vint, the first power source ELVDD supplied to the power source line VLn can maintain the second voltage V2 (that is, the first power source ELVDD supplied to the power source line VLn can remain substantially constant at the second voltage V2). In this case, the pixels 140" can be commonly coupled to the first power source ELVDD. Since the other operation processes are the same as the operation processes according to the embodiment of the present invention illustrated in FIG. 3, a more detailed description thereof will be omitted.

Figure 7:
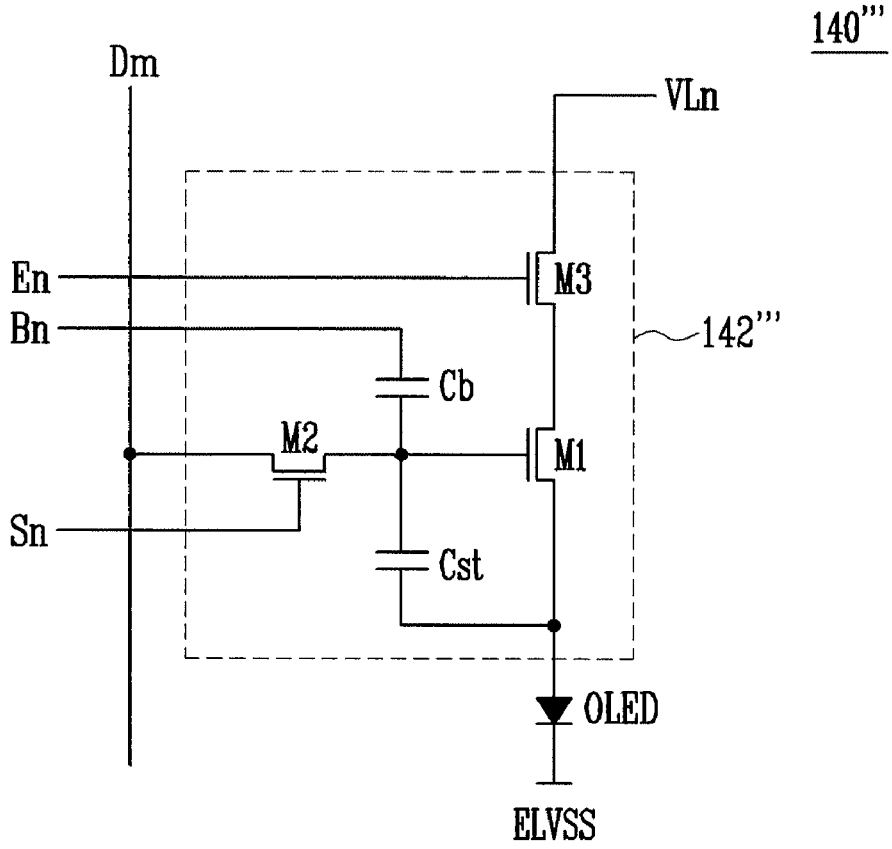
FIG. 7 illustrates a circuit diagram of another embodiment of the pixel of FIG. 2.

FIG. 7 illustrates a circuit diagram of a pixel according to another embodiment of the present invention. In FIG. 7, the same elements as the elements of FIG. 3 are denoted by the same reference numerals, and a detailed description thereof will be omitted.

Referring to FIG. 7, the pixel 140''' includes the OLED and a pixel circuit 142''' coupled to the data line Dm, the emission control line En, the scan line Sn, and a boosting line Bn to control the OLED.

The boosting lines (e.g., Bi to Bn) run parallel with corresponding scan lines S1 to Sn. The boosting line Bn receives a boosting signal from the scan driver 110. The boosting signal supplied to an ith boosting line Bi substantially overlaps with (e.g., is supplied at substantially a same time as) the emission control signal supplied to the ith emission control line Ei, and has a different polarity from the polarity of the emission control signal. For example, when the emission control signal is set to have a voltage of a low level, the boosting signal is set to have a voltage of a high level.

The anode electrode of the OLED is coupled to the pixel circuit 142''' and the cathode electrode of the OLED is coupled to the second power source ELVSS. The OLED generates light with brightness (e.g., predetermined brightness) corresponding to current supplied from the pixel circuit 142'''.

The pixel circuit 142''' charges the voltage corresponding to the data signal and the threshold voltage of the first transistor M1 in the storage capacitor Cst and supplies the current corresponding to the charged voltage to the OLED. The pixel circuit 142''' includes a boosting capacitor Cb coupled between the boosting line Bn and the gate electrode of the first transistor M1. The boosting capacitor Cb controls the voltage of the gate electrode of the first transistor M1 corresponding to the boosting signal supplied to the boosting line Bn.

Figure 8:
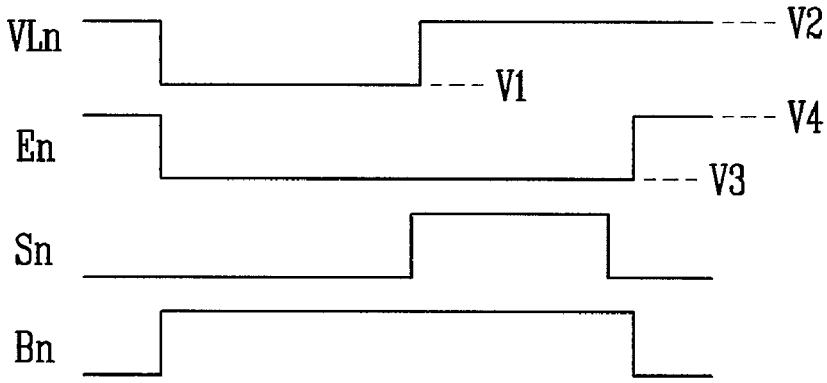
FIG. 8 illustrates waveforms describing a method of driving the pixel of FIG. 7.

FIG. 8 illustrates waveforms for driving the pixel of FIG. 7.

When explaining processes of operating the pixel 140''' in detail with reference to FIGS. 7 and 8, a first power source ELVDD is first set at a first voltage V1 and is supplied to the power source line VLn. An emission control signal is concurrently supplied to the emission control line En and the boosting signal (having a high voltage) is supplied to the boosting line Bn.

When the boosting signal is supplied to the boosting line Bn, the voltage of the gate electrode of the first transistor M1 increases due to the boosting capacitor Cb. When the first voltage V1 is supplied to the power source line VLn, the anode electrode of the OLED is initialized. In this case, the OLED is in an off-state.

After the OLED is turned off, the first power source ELVDD having the second voltage V2 higher than the first voltage V1 is supplied to the power source line VLn and a scan signal (having a high voltage) is supplied to the scan line Sn.

When the scan signal is supplied to the scan line Sn, the second transistor M2 is turned on. When the second transistor M2 is turned on, the data signal from the data line Dm is supplied to the gate electrode of the first transistor M1. Here, the data signal is set to have a higher voltage than the voltage of the grayscale to be displayed.

When the second voltage V2 is supplied to the power source line VLn, the voltage of the second electrode of the third transistor M3 and the voltage of the second electrode of the first transistor M1 gradually increase. Actually, the voltage of the second electrode of the third transistor M3 and the voltage of the second electrode of the first transistor M1 increase to the voltage V3−Vth(M3) obtained by subtracting the threshold voltage of the third transistor M3 from the third voltage V3. After the voltage of the second electrode of the third transistor M3 increases to the voltage obtained by subtracting the threshold voltage of the third transistor M3 from the third voltage V3, the third transistor M3 is turned off.

Since the data signal is set to have a higher voltage than the voltage of the gray level to be displayed, the storage capacitor Cst charges the voltage corresponding to the threshold voltage of the third transistor M3 within a short time.

Then, when the supply of the emission control signal to the emission control line En is suspended (e.g., when the emission control signal goes from V3 to V4), the supply of the boosting signal to the boosting line Bn is suspended (e.g., the boosting signal becomes low). When the supply of the boosting signal is suspended, the voltage of the boosting line Bn is reduced to a low voltage. In this case, the voltage of the gate electrode of the first transistor M1 is reduced by the boosting capacitor Cb. In addition, the voltage of the second electrode of the first transistor M1 is reduced due to the storage capacitor Cst.

Here, the reduction of the voltage at the gate electrode of the first transistor M1 is set to be larger than the reduction of the voltage of the second electrode (the amount of change in the reduced voltage is determined by the capacitance of the boosting capacitor Cb and the capacitance of the storage capacitor Cst). For example, when the voltage of the gate electrode of the first transistor M1 is reduced by 5V, the voltage of the second electrode of the first transistor M1 may be reduced by 3V. In this case, the voltage Vgs of the first transistor M1 becomes smaller than when the boosting signal is supplied.

That is, in the pixel 140''', to increase the voltage charging speed of the storage capacitor Cst, a data signal having a higher voltage than the voltage of a desired gray level is supplied and the voltage of Vgs of the first transistor M1 is controlled so that the brightness of a desired gray level is displayed using the boosting capacitor Cb. Here, the low voltage and the high voltage of the boosting signal and the voltage of the data signal are experimentally determined considering the size of a panel and the capacitance of the boosting capacitor Cb and the capacitance of the storage capacitor Cst.

When the supply of the emission control signal to the emission control line En is suspended, the third transistor M3 is sufficiently turned on. In this case, the first transistor M1 supplies the current corresponding to the voltage charged in the storage capacitor Cst to the OLED via the third transistor M3.

Figure 9:
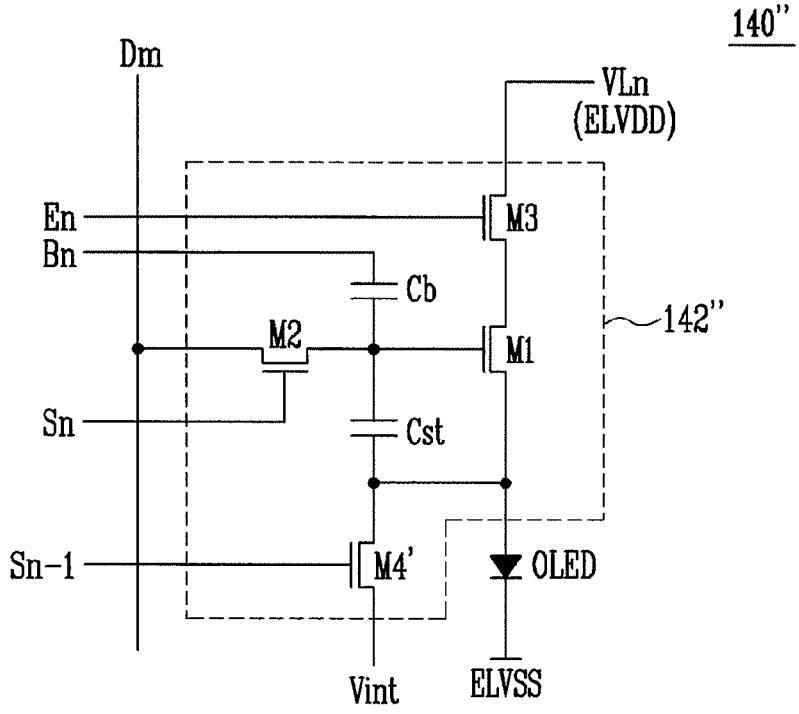
FIG. 9 illustrates a circuit diagram of another embodiment of the pixel of FIG. 6.

Meanwhile, the above-described boosting capacitor Cb can be variously applied to the pixels according to the various embodiments of the present invention. For example, the boosting capacitor Cb can be provided in the pixel 140" according to the embodiment of FIG. 6, as illustrated in FIG. 9. In this case, a voltage of the data signal is higher than the voltage of the desired gray level. However, the remaining operation processes are the same as the operation processes of the pixel 140" according to the embodiment of the present invention described with respect to FIG. 6.

Figure 10:
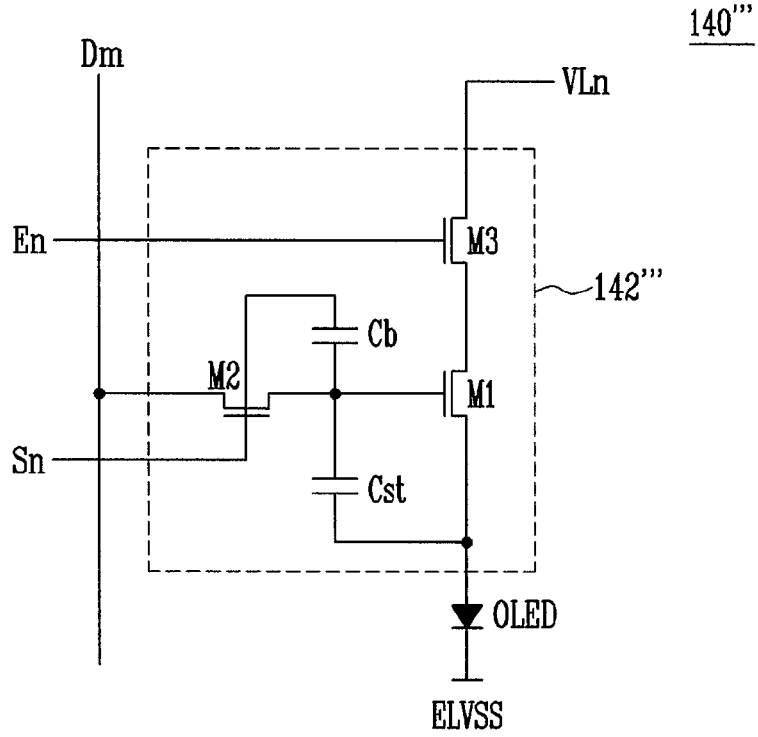
FIG. 10 illustrates a circuit diagram of another embodiment of the pixel of FIG. 7.

Furthermore, according to another embodiment of the present invention, the embodiment of FIG. 7 can be modified, such that the boosting capacitor Cb can be coupled between the scan line Sn and the gate electrode of the first transistor M1 as illustrated in FIG. 10. In this case, when the supply of the scan signal is suspended, the boosting capacitor Cb reduces the gate electrode voltage of the first transistor M1. Although the boosting capacitor Cb is coupled between the scan line Sn and the first transistor M1, the remaining operation processes are the same as the operation processes of the pixel 140' according to the embodiment of the present invention illustrated in FIG. 7. However, a voltage of the data signal is higher than the voltage of the desired gray level.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. An organic light emitting display, comprising:

a scan driver for sequentially supplying a scan signal to scan lines and sequentially supplying an emission control signal to emission control lines;

a data driver for supplying a data signal to data lines in synchronization with the scan signal supplied to the scan lines;

a power source unit for supplying a first power to power source lines; and pixels positioned at crossing regions of the scan lines, the emission control lines, and the data lines, wherein each of the pixels positioned on an ith (i is a natural number) horizontal line comprises:

an organic light emitting diode (OLED);

a first transistor coupled between a corresponding one of the power source lines and an anode electrode of the OLED for controlling current supplied to the OLED;

a second transistor turned on when the scan signal is supplied to an ith scan line of the scan lines for supplying the data signal from a corresponding one of the data lines to a gate electrode of the first transistor;

a third transistor coupled between the first transistor and the corresponding one of the power source lines and having a gate electrode coupled to an ith emission control line of the emission control lines; and a storage capacitor coupled between the gate electrode of the first transistor and the anode electrode of the OLED.

2. The organic light emitting display as claimed in claim 1, wherein the scan driver is configured to supply the emission control signal to the ith emission control line concurrently with supply of the scan signal to an (i−1)th scan line of the scan lines or the ith scan line.

3. The organic light emitting display as claimed in claim 2, wherein the emission control signal is set at a voltage for setting the third transistor to a weak turn-on state.

4. The organic light emitting display as claimed in claim 3, wherein when the emission control signal is not supplied, a voltage higher than the voltage for setting the third transistor to a weak turn-on state is supplied to the ith emission control line for turning the third transistor on.

5. The organic light emitting display as claimed in claim 2, wherein the power source lines are arranged parallel to corresponding ones of the scan lines.

6. The organic light emitting display as claimed in claim 5, wherein the first power having a first voltage is supplied to an ith power source line concurrently with the scan signal supplied to the (i−1)th scan line, and the first power having a second voltage higher than the first voltage is supplied to the power source lines other than the ith power source line when the scan signal is supplied to the (i−1)th scan line.

7. The organic light emitting display as claimed in claim 6, wherein the first voltage is set at a voltage for turning the OLED off.

8. The organic light emitting display as claimed in claim 2, further comprising a fourth transistor coupled between the third transistor and the OLED, and turned on when a scan signal is supplied to the ith scan line.

9. The organic light emitting display as claimed in claim 2, further comprising a fourth transistor coupled between the anode electrode of the OLED and an initialization power source, and turned on when the scan signal is supplied to the (i−1)th scan line.

10. The organic light emitting display as claimed in claim 9, wherein the initialization power source is set at a voltage for turning the OLED off.

11. The organic light emitting display as claimed in claim 9, wherein the first power having a substantially constant voltage is supplied to the power source lines.

12. The organic light emitting display as claimed in claim 9, wherein the scan driver is further configured to sequentially supply a boosting signal to boosting lines.

13. The organic light emitting display as claimed in claim 12, wherein the boosting signal supplied to an ith boosting line of the boosting lines is supplied concurrently with the emission control signal supplied to the ith emission control line, and is set at a voltage having a polarity opposite to a polarity of a voltage of the emission control signal.

14. The organic light emitting display as claimed in claim 13, further comprising a boosting capacitor coupled between the ith boosting line and the gate electrode of the first transistor.

15. The organic light emitting display as claimed in claim 14, wherein a voltage of the data signal is higher than a voltage of a gray level to be displayed.

16. The organic light emitting display as claimed in claim 2, further comprising a boosting capacitor coupled between the ith scan line and the gate electrode of the first transistor.

17. The organic light emitting display as claimed in claim 16, wherein a voltage of the data signal is higher than a voltage of a gray level to be displayed.

18. The organic light emitting display as claimed in claim 2, wherein the scan driver is further configured to sequentially supply a boosting signal to boosting lines.

19. The organic light emitting display as claimed in claim 18, wherein the boosting signal supplied to an ith boosting line of the boosting lines is supplied concurrently with the emission control signal supplied to the ith emission control line, and is set at a voltage having a polarity opposite to a polarity of a voltage of the emission control signal.

20. The organic light emitting display as claimed in claim 19, further comprising a boosting capacitor coupled between the ith boosting line and the gate electrode of the first transistor.

21. The organic light emitting display as claimed in claim 20, wherein a voltage of the data signal is higher than a voltage of a gray level to be displayed.

22. The organic light emitting display as claimed in claim 1, wherein the transistors of the pixels are NMOS transistors.

* * * * *

US008242984C1

(12) EX PARTE REEXAMINATION CERTIFICATE (49th)

Ex Parte Reexamination Ordered under 35 U.S.C. 257

United States Patent
Choi

(10) Number: US 8,242,984 C1
(45) Certificate Issued: Mar. 1, 2016

(54) ORGANIC LIGHT EMITTING DISPLAY

(75) Inventor: Sang-Moo Choi, Yongin (KR)

(73) Assignee: SAMSUNG DISPLAY CO., LTD., Giheung-Gu, Yongin-Si, Gyeonggi-Do (KR)

Supplemental Examination Request:
No. 96/000,108, May 27, 2015

Reexamination Certificate for:

| | |
|---|---|
| Patent No.: | **8,242,984** |
| Issued: | **Aug. 14, 2012** |
| Appl. No.: | **12/713,154** |
| Filed: | **Feb. 25, 2010** |

(30) Foreign Application Priority Data

Mar. 2, 2009 (KR) ..... 10-2009-0017542

(51) Int. Cl.
*G09G 3/30* (2006.01)
*G09G 3/32* (2006.01)

(52) U.S. Cl.
CPC ..... *G09G 3/32* (2013.01)

(58) Field of Classification Search
CPC ..... G09G 3/20; G09G 3/22; G09G 3/29; G09G 3/32; G09G 3/296; G09G 3/346; G09G 3/2927; G09G 3/3233; G09G 3/3648; G09G 3/3688; G09G 2300/0842; G09G 2300/0408; G09G 5/005; G09G 5/006
USPC ..... 345/76–83, 204–215, 690–699; 315/169.1–169.4
See application file for complete search history.

(56) References Cited

To view the complete listing of prior art documents cited during the supplemental examination proceeding and the resulting reexamination proceeding for Control Number 96/000,108, please refer to the USPTO's public Patent Application Information Retrieval (PAIR) system under the Display References tab.

*Primary Examiner* — Henry Tran

(57) ABSTRACT

An organic light emitting display includes pixels positioned at crossing regions of scan lines, emission control lines, and data lines. Each of the pixels positioned on an ith horizontal line includes an organic light emitting diode (OLED), a first transistor coupled between a corresponding one of power source lines and an anode electrode of the OLED for controlling current supplied to the OLED, a second transistor turned on when a scan signal is supplied to an ith scan line for supplying the data signal from a corresponding one of the data lines to a gate electrode of the first transistor, a third transistor coupled between the first transistor and the corresponding one of the power source lines and having a gate electrode coupled to an ith emission control line, and a storage capacitor coupled between the gate electrode of the first transistor and the anode electrode of the OLED.

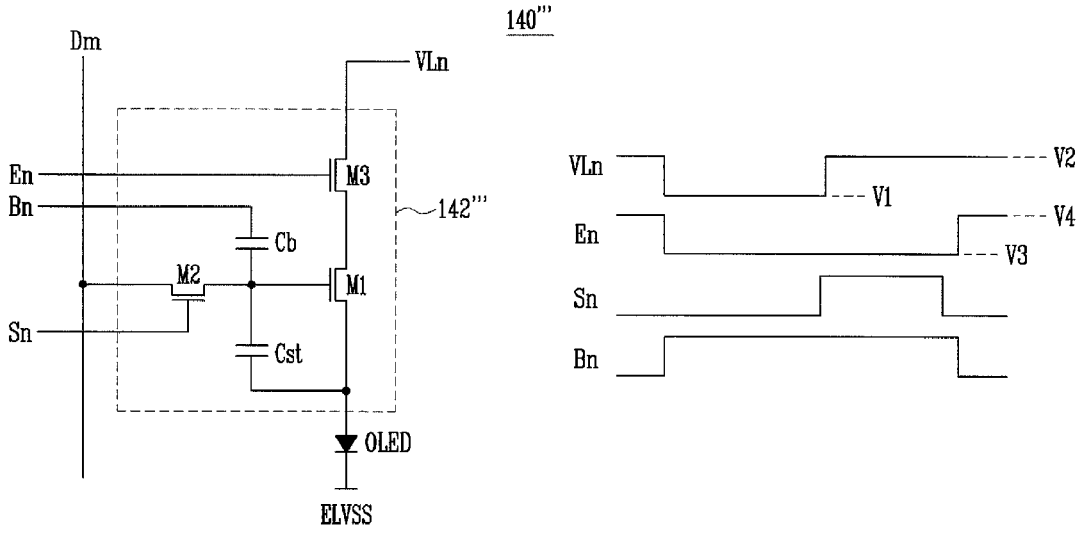

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3-21 is confirmed.

Claims 1, 2 and 22 are cancelled.

New claims 23-25 are added and determined to be patentable.

*23. An organic light emitting display, comprising:*

*a scan driver for sequentially supplying a scan signal to scan lines and sequentially supplying an emission control signal to emission control lines;*

*a data driver for supplying a data signal to data lines in synchronization with the scan signal supplied to the scan lines;*

*a power source unit for supplying a first power to power source lines; and*

*pixels positioned at crossing regions of the scan lines, the emission control lines, and the data lines,*

*wherein each of the pixels positioned on an ith (i is a natural number) horizontal line comprises:*

*an organic light emitting diode (OLED);*

*a first transistor coupled between an ith power source line of the power source lines and an anode electrode of the OLED for controlling current supplied to the OLED;*

*a second transistor turned on when the scan signal is supplied to an ith scan line of the scan lines for supplying the data signal from a corresponding one of the data lines to a gate electrode of the first transistor;*

*a third transistor coupled between the first transistor and the ith power source line and having a gate electrode coupled to an ith emission control line of the emission control lines; and*

*a storage capacitor coupled between the gate electrode of the first transistor and the anode electrode of the OLED;*

*wherein the first power having a first voltage is supplied to the ith power source line, while the first power having a second voltage different than the first voltage is concurrently supplied to at least another one of the power source lines.*

*24. The organic light emitting display as claimed in claim 23, wherein the scan driver is configured to supply the emission control signal to the ith emission control line concurrently with supply of the scan signal to an (i-1)th scan line of the scan lines or the ith scan line.*

*25. The organic light emitting display as claimed in claim 23, wherein the transistors of the pixels are NMOS transistors.*

* * * * *